US009236054B2

(12) United States Patent
Zhou et al.

(10) Patent No.: US 9,236,054 B2
(45) Date of Patent: Jan. 12, 2016

(54) SYSTEM AND METHOD FOR CONTROLLING AUDIO DATA PROCESSING

(71) Applicant: INTEL CORPORATION, Santa Clara, CA (US)

(72) Inventors: Xiaocheng Zhou, Beijing (CN); Shoumeng Yan, Beijing (CN)

(73) Assignee: Intel Corporation, Santa Clara, CA (US)

( * ) Notice: Subject to any disclaimer, the term of this patent is extended or adjusted under 35 U.S.C. 154(b) by 200 days.

(21) Appl. No.: 14/006,840

(22) PCT Filed: Sep. 29, 2012

(86) PCT No.: PCT/CN2012/082431

§ 371 (c)(1),
(2) Date: Sep. 23, 2013

(87) PCT Pub. No.: WO2014/047921

PCT Pub. Date: Apr. 3, 2014

(65) Prior Publication Data

US 2015/0012281 A1 Jan. 8, 2015

(51) Int. Cl.
*G10L 19/00* (2013.01)
*G10L 19/16* (2013.01)

(52) U.S. Cl.
CPC ..... *G10L 19/0019* (2013.01); *G10L 19/167* (2013.01)

(58) Field of Classification Search
CPC .... H04L 65/80; H04N 19/132; H04N 19/156; H04N 19/172; H04N 19/176
USPC ..... 704/500; 348/441, 572, 720; 710/33, 710/34, 48, 260, 261, 269; 370/310, 469, 370/509; 375/136; 714/749, 795, 775, 776; 709/236; 398/154; 711/105, 209
See application file for complete search history.

(56) References Cited

U.S. PATENT DOCUMENTS

| | | | | |
|---|---|---|---|---|
| 5,982,431 | A | 11/1999 | Chung | |
| 8,402,190 | B2 * | 3/2013 | Isrel et al. | 710/261 |
| 2004/0019491 | A1 | 1/2004 | Rhee | |
| 2007/0153907 | A1 | 7/2007 | Mehta et al. | |
| 2012/0173811 | A1 * | 7/2012 | Barth et al. | 711/105 |

FOREIGN PATENT DOCUMENTS

| | | |
|---|---|---|
| CN | 101378512 | 3/2009 |
| WO | 2014/047921 A1 | 4/2014 |

OTHER PUBLICATIONS

International Search Report for PCT/CN2012/082431 dated Jun. 13, 2013.

* cited by examiner

*Primary Examiner* — Charlotte M Baker
(74) *Attorney, Agent, or Firm* — KED & Associates LLP

(57) ABSTRACT

An audio accelerator includes a decoder to decode first and second sets of data blocks, a processor to process the first and second sets of decoded data blocks, a storage area to store the first and second sets of processed data blocks, and a controller to generate interrupt signals for controlling operation of the decoder. The controller may control a rate at which data blocks are to be decoded by the decoder to reduce a time gap between outputting adjacent ones of the data blocks from the first and second sets in the storage area.

26 Claims, 4 Drawing Sheets

SYSTEM AND METHOD FOR CONTROLLING AUDIO DATA PROCESSING

FIELD

One or more embodiments described herein relate to processing audio data.

BACKGROUND

The efficient processing of data in electronic devices continues to be of focus among system designers. This is especially true of consumer electronics which require high quality data output, irrespective of whether the data source is the internet or an internal storage unit.

DETAILED DESCRIPTION

Figure 1:
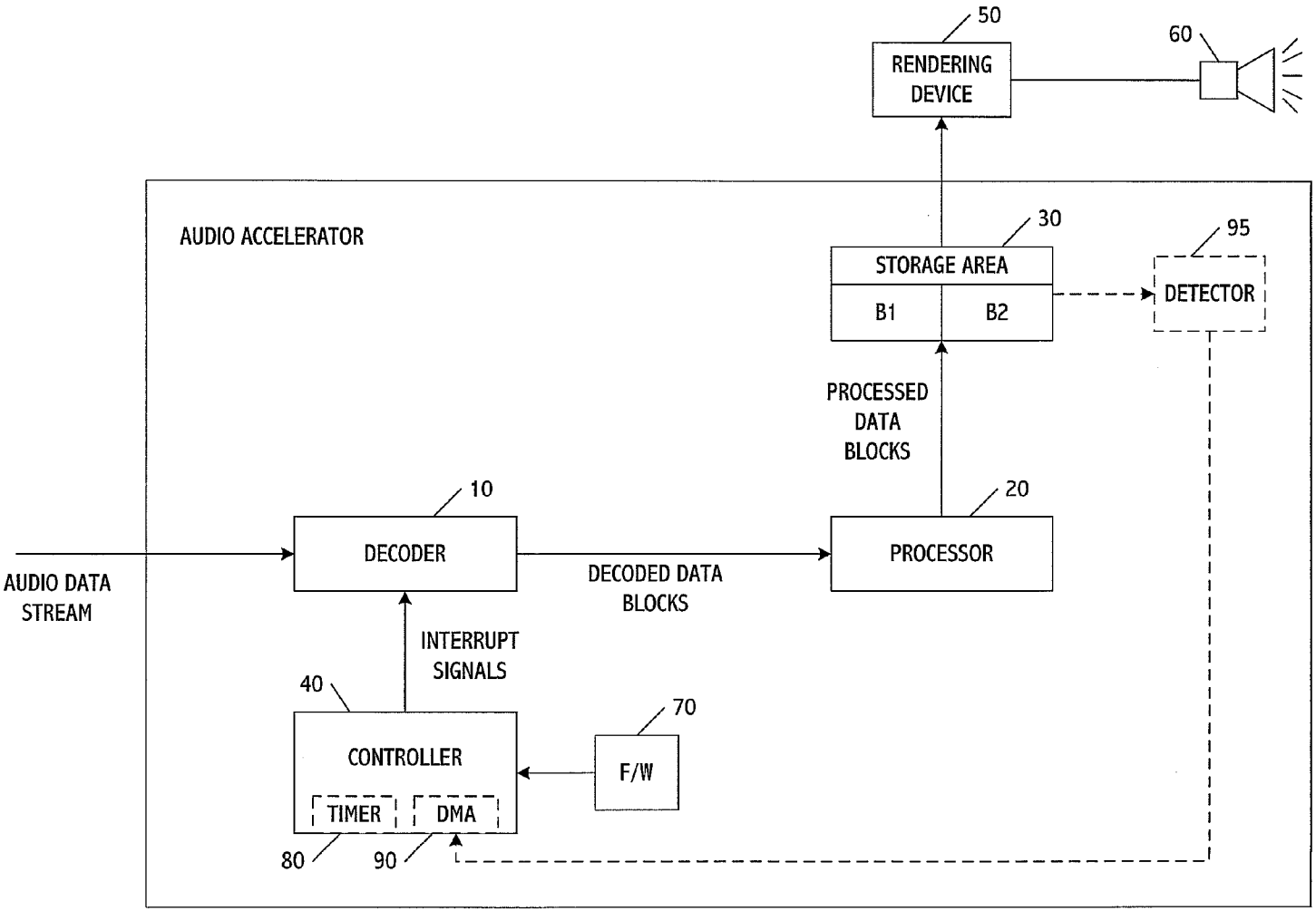
FIG. 1 shows one embodiment of an audio accelerator.

FIG. 1 shows one embodiment of an audio accelerator which includes a decoder 10, a processor 20, and a storage area 30. The decoder and processor may be implemented as different software stages or, alternatively, one or more of the decoder and processor may be implemented by hardware elements. The audio accelerator may be included in a variety of electronic devices including but not limited to a mobile phone, media player, pod- or pad-type device, navigation device, satellite radio terminal, internet terminal, television, headphones and a personal or notebook computer as well as other mobile or stationary devices that output sound.

According to one particular embodiment, the audio accelerator is implemented in a system-on-chip (SoC). In such an implementation, audio may be output in a low-power state of the host device or system to thereby reduce battery power consumption. In other embodiments, the audio accelerator may be provided separately from the system chip, e.g., the main chipset or processor chip of the host device or system.

In one implementation, the audio accelerator may process audio separately from a central processing unit (CPU) of the host device or system, for example, in order to reduce power consumption and/or processing overhead of the CPU. By offloading the decoder function from the CPU to the audio accelerator, a significant reduction in power consumption may be realized. Also, use of an audio accelerator for this purpose may reduce costs while at the same time allowing for real-time audio playback, although this is not a necessity. In other embodiments the accelerator may operate with or be performed by the CPU.

Returning to FIG. 1, the decoder 10 receives an audio data stream and performs a decoding function to generate a plurality of decoded audio data blocks. The audio data stream may be received from any one of a variety of sources such as multimedia data internally stored in the host device or system or a data stream from a receiver coupled, for example, to the internet, a computer, a tuner, or another data source.

In accordance with one embodiment, the input audio data stream is received in a first format (e.g., Moving Picture Experts Group (MP3) format) and the decoding function generates a plurality data blocks in a second format. For example, the decoding function may generate a plurality of pulse-coded modulation (PCM) data blocks from the input audio data stream. In other embodiments, the decoding function may produce data blocks in a format different from PCM.

The processor 20 receives the data blocks output from the decoder and then performs one or more predetermined operations on these blocks. These operations may include various post-processing functions such as sample-rate conversion according to a predetermined scheme programmed, for example, into firmware for controlling the audio accelerator. The sample rate conversion to be performed may correspond, for example, to a sampling rate of a post-processor component such as a rendering device, to be described in greater detail. This firmware may also be used to control the decoder, although this is not necessary.

The storage area stores the data blocks output from the processor for a temporary period of time and then the blocks are transferred to a rendering device 50. In accordance with one embodiment, the storage area may correspond to different locations in a same memory. In accordance with another embodiment, the storage area may include at least two buffers B1 and B2 which are used to store respective ones of the processed data blocks. In other embodiments, there may only be one buffer or more than two buffers.

In a two-buffer arrangement, the buffers may operate according to a ping-pong buffering scheme. According to one possible implementation of this scheme, a first buffer receives a data block for storage while the data block stored in the second buffer is output. Then, the roles of the buffers are reversed, i.e., the second buffer receives a data block for storage while the data block in the first buffer is output.

According to another implementation of this scheme, the first buffer may always be used to receive data for storage and the second buffer may always be used to output data. Thus, when a data block is output from the second buffer, the data in the first buffer is stored in the second buffer and the first buffer receives the next data block for storage. In FIG. 1, a two-buffer scheme is depicted for illustrative purposes.

In other embodiments, more than two buffers may be used, for example, according to a triple-buffering or other multiple-buffering type scheme. In these embodiments, the data blocks may include a number of bits determined, for example, according to packet format of the type of audio or other data that is being processed for output.

The audio accelerator and the rendering device may operate concurrently and may be performed by different chips or circuits. Accordingly, output of the data blocks from the buffers may be at a rate compatible with an operational speed of the rendering device in order to ensure proper continuity and quality of audio output. One example of a rendering device is a digital-to-audio converter which outputs analog audio signals to one or more speakers, generally shown by reference numeral 60. In alternative embodiments, the audio accelerator and rendering device may be included on a same chip, in a same circuit, or a same package.

The audio accelerator also includes a controller 40 for controlling the scheduling of audio data through the decoder and processor. In accordance with one embodiment, the controller outputs interrupt signals to the decoder at predetermined times in order to reduce or prevent the formation of time gaps between the storage of data blocks into the buffers. These time gaps may lead to the generation of noise, distortion, and/or other deleterious effects in the output sound. By reducing or eliminating the time gaps, output (e.g., rendering) of the data from the buffers to the rendering device may occur in a continuous or more continuous manner. In accordance with one embodiment, this may translate into improved sound quality, efficiency, and/or other effects.

The time gaps may be formed as a result of the decoder and processor running serially in a same processing core. In such a case, the decoder and processor cannot be individually stopped and switched between during the middle of handling one item of audio data.

Figure 2:
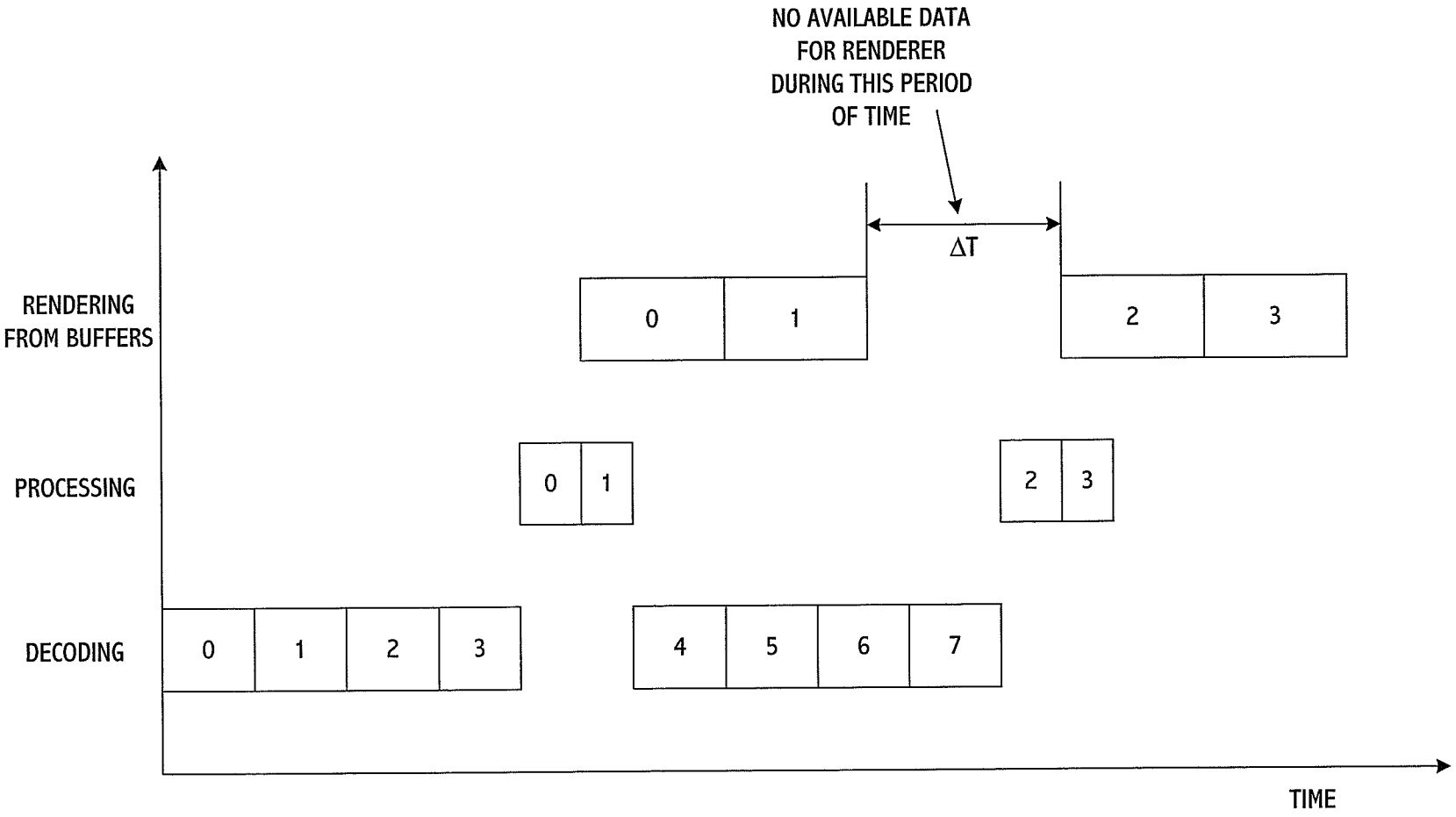
FIG. 2 shows time gaps formed in the rendering of audio data.

FIG. 2 shows an example of how time gaps can occur. In this example, time gaps are produced as a result of time delays that occur in outputting data from the buffers. The slow rendering time of the buffers places a limitation on operation of the processor.

More specifically, as shown in FIG. 2, the decoder processes an input data stream and outputs four data blocks in sequence without interruption each time the decoder is scheduled to run. While four blocks are shown, the number of blocks may be different from four in other embodiments. The number may be determined by implementation of the decoder.

After the data blocks are decoded, the processor is scheduled to run. (The decoder and processor are scheduled to operate sequentially in one implementation when there is only one processing core in the audio accelerator). Because only two buffers are used at the output of the processor, the processor is limited in how fast it can output processed data blocks to the buffers. More specifically, the processor has to wait until data block (0) in the buffers is output to the rendering device before additional data blocks can be stored in the buffers from the processor.

Now, it is time for the decoder to run. Because the decoder is to decode data blocks (4, 5, 6, 7) as a whole, the processor has no chance to process data block (2) even after data blocks (0, 1) have been rendered. This produces a gap in time ($\Delta T$) in the rendering of data blocks from the buffers, which translates into noise in the output sound. The greater the time gap, the greater the likelihood of noise or other forms of distortion in the output sound.

In accordance with one embodiment, the controller 40 schedules operation of the decoder to reduce or prevent the formation of time gaps in the storage of data blocks into and the outputting of data blocks from the buffers. In accordance with one embodiment, scheduling is performed by introducing interrupts during operation of the decoder at specific times. Because processing through the audio accelerator is performed sequentially from the decoder to the processor to the buffers, the interrupts produce time delays that bring decoder operation more in line with operation of the processor and subsequent storage of processed data blocks in the buffer. More importantly, the interrupts provide an opportunity for the processor to run during the middle of decoding the second set of data blocks. The interrupts, therefore, reduce or prevent the formation of time gaps in the storage into and output of data blocks from the buffer.

Put differently, the interrupts are timed to take into account disparities in the operational speeds of the decoder and processor and the output rate of data blocks from the buffers to reduce the time gaps. These interrupts become part of the scheduling of the operation of the decoder. The generation of these interrupts may be controlled, for example, by firmware for the controller. Examples that correspond to the scheduling of these interrupts will now be discussed.

Figure 3:
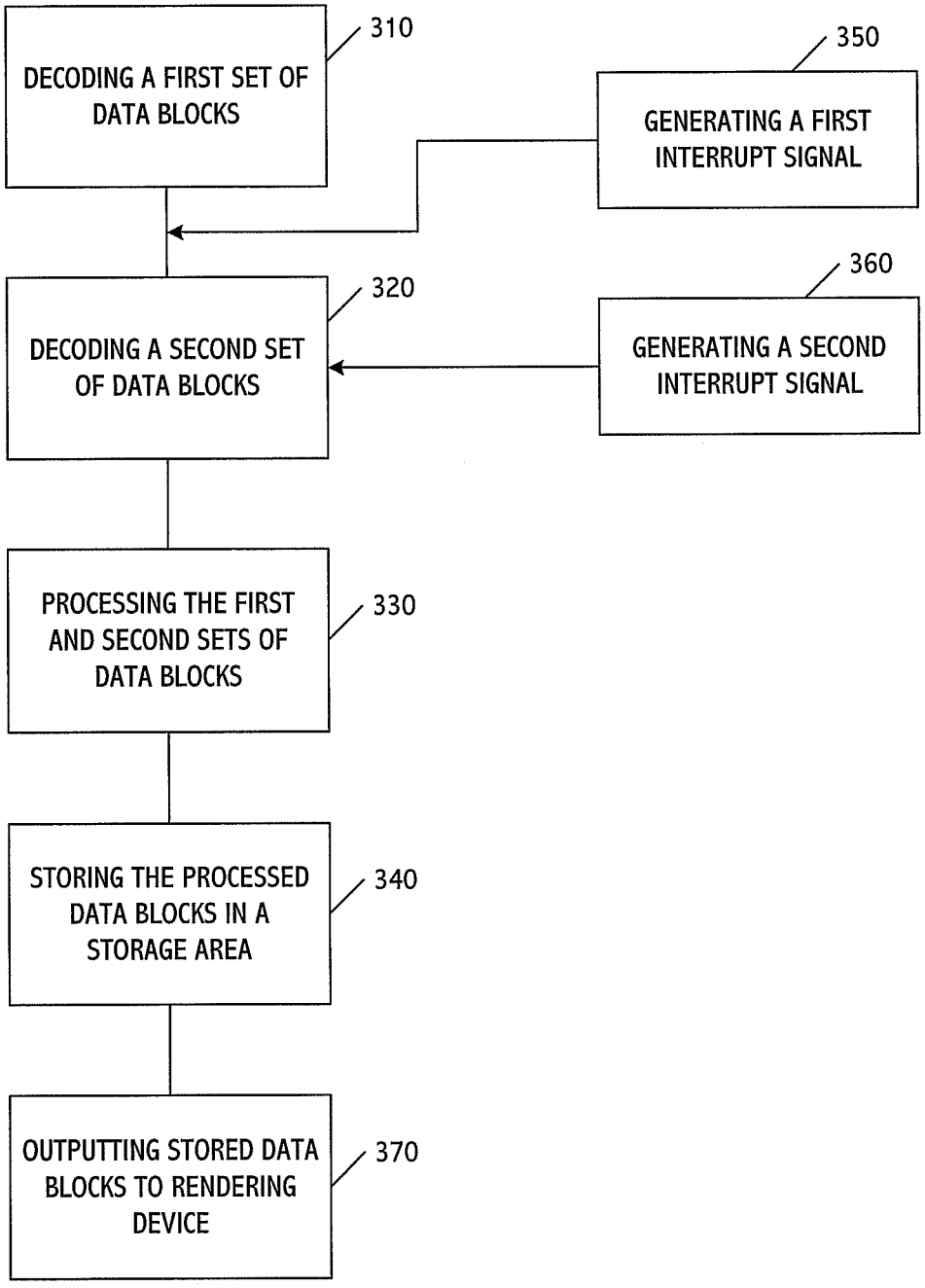
FIG. 3 shows one embodiment of a method for controlling an audio accelerator.

FIG. 3 shows operations included in one embodiment of a method for scheduling the processing of data in an electronic device. While the method may be applied to the processing of data blocks of any type, the method may have particular relevance to processing audio data blocks in an audio accelerator such as shown in FIG. 1.

An initial operation of the method includes decoding a first set of data blocks. (Block 310). As indicated, the data blocks may be data of any type but audio data blocks may be used in the contents of an audio accelerator. The number of data blocks may be determined based on the input audio stream, and the number of bits per block may be determined based on the payload size or format of the packets containing the data.

After this operation, a second set of data blocks are decoded. (Block 320). The number of data blocks in the second set may be the same or different from the number of blocks in the first set. Also, the blocks in the first and second sets may be sequentially decoded by a decoder. However, in other embodiments, a parallel-decoding scheme may be used for the blocks.

In another operation, the first and second sets of decoded data blocks are processed. (Block 330). The processing may involve one or more functions required to be performed by the host device or system for purposes of rendering the data for output. In the case of video data, the processing may involve processing the data for output on a display. And, in the case of audio data, the processing may involve processing the data for output through a speaker. When applied to the embodiment of FIG. 1, the processing function may include a sampling rate conversion.

In another operation, the processed data blocks are stored in a storage area. (Block 340). The storage area may be a region of addresses in a memory or may correspond to a plurality of buffers for temporarily storing the data before the data is output for further processing. In the embodiment of FIG. 1, the storage area may correspond to two buffers B1 and B2 operating according to, for example, a ping pong buffering scheme. Because only two buffers are used in this embodiment, the storage time into the buffers and the time for outputting (rendering) the data blocks from the buffers is less than the decoding and processing times for a same number of data blocks.

In order to prevent or reduce the duration of time gaps in storing and rendering the data blocks, a scheduling scheme is employed. According to this scheme, scheduling is performed by generating a first interrupt signal between decoding of the first and second sets of data blocks. (Block 350). The interrupt signal suspends operation of the decoder for a predetermined delay time. During this time, the processor may process a predetermined number of data blocks from the first set. This predetermined number may be one or more but fewer than all the data blocks in the first set and the number of buffers in the storage area.

The first interrupt signal allows the processed data blocks to initially fill the buffers for rendering to a rendering device. At the conclusion of processing the predetermined number of data blocks, decoding may resume for data blocks in the second set. During this time (e.g., during decoding of the blocks in the second set), storage and rendering of the processed blocks in the buffers may take place.

The scheduling scheme continues by generating a second interrupt signal during decoding of the second set of data blocks. (Block 360). The interrupt signal may be applied at a time between decoding of the first data block in the second set and decoding of the last data block in the second set. In the embodiment of FIG. 1, the controller applies the second interrupt signal to suspend operation of the decoder at a midpoint between decoding the blocks in the second set. In other embodiments, the second interrupt signal may be applied at another point. The decoder operation may be suspended for a second delay time based on the second interrupt signal.

Suspending operation of the decoder during decoding of data blocks in the second set allows one or more additional blocks in the first set to be processed before remaining blocks in the second set are decoded. This helps to reduce or eliminate time gaps between the storage of data blocks of the first set in the buffers (in the case of FIG. 1) and their subsequent output (rendering) to a rendering device (e.g., digital-to-analog converter 50 in the case of FIG. 1). The number of data blocks in the first and second sets may be the same or different.

The scheduling scheme may continue by generating additional interrupt signals during decoding of subsequent data block in the second set, for the purpose of further suspending operation of the decoder. This allows additional data blocks from the first set to be processed during decoding of blocks in the second set for storage in the buffers. The result is to reduce or eliminate time gaps in storing these additional blocks in the buffers, all of which may translate into reduced noise in the output of the blocks. The scheme continues until all blocks in the input stream are decoded, processed, stored, and set to a rendering device. (Block 370).

In the foregoing embodiment, the first and second sets of processed data blocks may be output at a first rate from the buffers to a circuit (rendering device), and the first and second sets of data blocks may be decoded at a second rate which is less than the first rate. Also, the delay times generated by the first, second, and subsequent interrupt signals may be the same or different. In one embodiment, the delay time generated by the first interrupt signal may be greater than the delay times generated by one or more subsequent interrupt signals.

Moreover, the interrupt signals may be generated and set to the decoder, because in accordance with at least one embodiment decoding of the data blocks in the first and second sets controls a rate of storing processed ones of the data blocks of the first and second sets in the buffers.

The timing of the interrupt signals may be controlled in a variety of ways. In one embodiment, the controller generating the interrupt signals may include or correspond to a timer for scheduling output of the interrupt signals to the decoder. The timer may be controlled to start and stop based on firmware stored for controlling the controller. In FIG. 1, the firmware is illustratively shown as being stored in memory 70 and the timer is illustratively shown by reference numeral 80.

In accordance with one embodiment, the timer may be controlled by the firmware to start and its expiring time may be set to be less than the time for storing one data block and/or rendering one audio data block to the rendering device. Each time the timer starts, the controller may generate an interrupt signal. In the embodiment of FIG. 1, the audio accelerator may at this time yield control to the processor irrespective of whether the decoder was currently decoding data.

In accordance with another embodiment, the controller generating the interrupt signals may include or correspond to a direct memory access (DMA) controller. The DMA controller may cause interrupt signals to be generated for the decoder based on completion of the storage of a predetermined number of data blocks into the buffers and/or output (rendering) of one or more data blocks from the buffers to a rendering device. In this regard, the DMA controller may receive a detection signal from a detection circuit coupled to the buffers to detect when the storage and/or rendering occurs.

The predetermined number of data blocks for controlling the DMA controller may change in accordance with the firmware based, for example, on the number of blocks that have already been decoded and/or the number of data blocks that have been processed for input into the buffers, and/or the number of data blocks that have been subjected to output rendering. In other embodiments, the number of data blocks for controlling the DMA controller may be the same.

In FIG. 1, the DMA controller is illustratively shown by reference numeral 90 and a detector for detecting data block storage and/or rendering is illustratively shown by reference numeral 95 which is coupled to the DMA controller. In this implementation, the processor may be scheduled by the controller to operate each time a DMA interrupt occurs. Output of data blocks from the buffers into the rendering device may be performed by controller 40 or another control circuit.

Whether the timer or DMA controller is used, the audio accelerator may be understood as yielding control to the processor upon receipt of a interrupt signal. As a result, processed data blocks can then be moved for storage into and subsequent rendering from the buffers to achieve continuous or near-continuous audio playing, without gaps or with gaps of reduced duration. After the processor processes one or more additional data blocks, control of the audio accelerator may return to the decoder which may already be decoding additional data blocks. After one or more additional data blocks are processed, control of the audio accelerator may switch back to the processor for storage into and rendering from the buffer.

In effect, then, in this embodiment the operation of the decoder and processor is interleaved, i.e., the decoding operation is performed in segments relative to received data blocks and the processor processes prior decoded blocks while the decoder is decoding subsequent blocks. As a result, the processor may continue to send data blocks to the rendering device in a continuous or near-continuous manner relative to remaining blocks in the stream.

Figure 4:
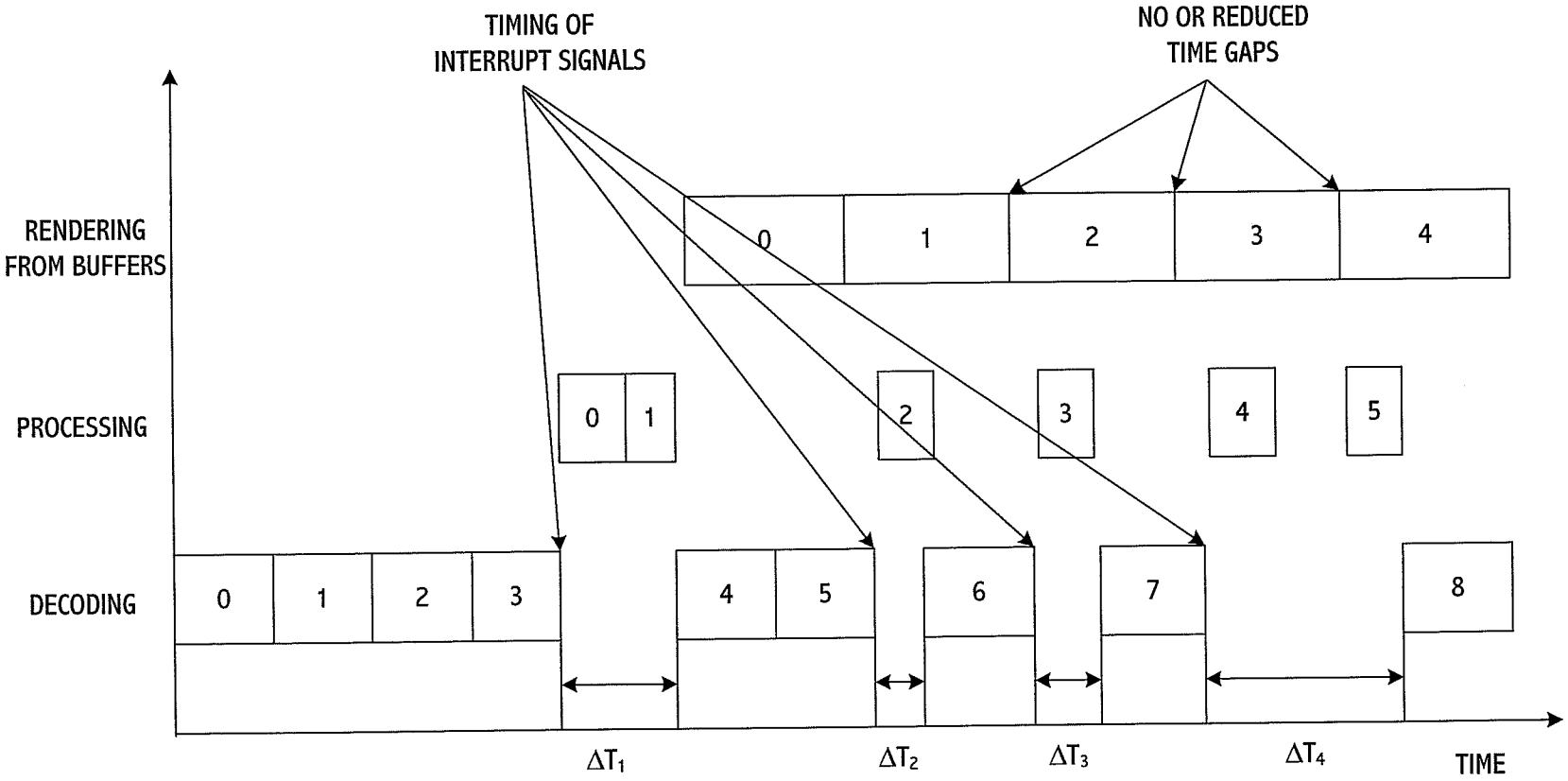
FIG. 4 shows an example of a timing diagram produced by the method of FIG. 3.

FIG. 4 shows an example of a timing diagram that may correspond to the flow of data blocks throughout the accelerator. In this example, the audio accelerator has two buffers for storing processed data blocks and the controller may generate interrupt signals based on either of the timer or DMA controller schemes previously described.

Referring to FIG. 4, an initial operation includes decoding a first set of N audio data blocks received from an input audio data stream. The number of data blocks to be decoded may depend on the decoder implementation. The number of data blocks to be processed by the processor 20 may correspond to P. The processed data blocks are stored in the buffers and then are to be output (rendered) from the buffers. In the example of FIG. 4, N is four and P is two. In other embodiments, N and P may be different values.

Upon receipt, the decoder decodes the N data blocks in succession. Decoding stops when an interrupt signal is received from the controller. The interrupt signal suspends operation of the decoder for a predetermined delay time ($\Delta T_1$). If the controller operates based on a timer, the delay time may correspond to a pre-stored time programmed into the firmware. If the controller operates based on a DMA controller, the delay time may correspond to the storage or output (rendering) time of one or more data blocks in the buffers. Alternatively, the delay time may be set to correspond to a period of time required for the processor 30 to process (e.g., perform a sampling rate conversion) of a predetermined number of data blocks, which in the case of FIG. 4 is two.

At the end of delay time $\Delta T_1$, the decoder begins to decode additional data blocks from the input audio stream. The decoder continues to decode until another interrupt signal is received from the controller. In this example, the number of additional blocks to be decoded is less than the number of blocks N decoded prior to receipt of the first interrupt signal. According to one embodiment, the number of additional data blocks is $N-C_1$ where $C_1$ is a constant. In the example of FIG. 4, $C_1=2$ so that $N-C_1=2$, i.e., the next two data blocks (4, 5) in sequence are decoded.

At this time or before, the data blocks (0,1) processed by processor 30 are input for storage into the buffers. Thereafter, the data blocks (0,1) are output (e.g., rendered) from the audio accelerator for transfer to the rendering device 50. This operation may be substantially coincident with the beginning of decoding of the additional blocks or may be performed at a different time.

At this time, the processor has not yet processed the remaining two (2, 3) data blocks decoded by the decoder, although introducing the interrupt signal corresponding to $\Delta T_1$ may provide the processor a chance to process data blocks (0, 1).

As a result, the processor processes the next data block (2) at substantially a same time as or after the decoder finishes decoding the additional blocks (4, 5). At this time, the controller introduces a second interrupt signal to suspend operation of the decoder for a delay time $\Delta T_2$. The second delay time may be a predetermined value that includes or substantially corresponds to the time required for the processor to process one data block, e.g., data block (2) in FIG. 4.

The introduction of a delay in operation of the decoder prevents the decoder from decoding another N additional data blocks before the second interrupt signal. This delay allows data block (2) processed by the processor to be rendered from the buffer without a gap in time. In other words, the time gap between when data block (1) is stored and/or rendered and when data block (2) is stored and/or rendered is reduced or eliminated. The reduction or elimination of this time gap may produce a corresponding reduction in noise in the output audio signal from the speakers for these data blocks.

When the delay time $\Delta T_2$ expires, the decoder decodes a number of additional data blocks $C_1$-$C_2$ where $C_2$ is a constant and $C_2 \leq C_1$. In the example of FIG. 4, $C_2=1$ so that $C_1-C_2=1$, i.e., the next data block (6) in sequence are decoded. Then, the controller issues a third interrupt signal to suspend operation of the decoder for a third delay time $\Delta T_3$. During the third delay time, the processor processes the last data block (3) of the first N data blocks decoded by the decoder and this processed block is then input for storage into a corresponding one of the buffers.

During the third time delay, data block (2) is output from the buffers to the rendering device. As a result of the second interrupt signal, a time gap between when data block (2) is stored and/or output to the rendering device and when data block (3) is stored and/or output to the rendering device is reduced or eliminated, thereby translating into reduced noise for the output of these data blocks through the speaker.

After the delay time $\Delta T_3$ expires, the decoder decodes a number of additional data blocks $C_2$-$C_3$ where $C_3$ is a constant and $C_3 \leq C_2$. In the example of FIG. 4, $C_3=1$ so that $C_2-C_3=1$, i.e., the next data block (7) in sequence are decoded. The controller then issues a fourth interrupt signal to suspend operation of the decoder for a fourth delay time $\Delta T_4$.

During this fourth delay time, one or more additional data blocks (4, 5) are processed by the processor and a fourth data block (3) is output from the buffers to the rendering device with a reduced time gap or substantially no time gap relative to output of data block (2) from the buffers.

The fourth delay time $\Delta T_4$ may be equal to or different from any of the previously three time delays based, for example, on pre-stored values. In FIG. 4, the fourth time delay includes or corresponds to the time required for the processor to process two additional data blocks (4,5). During this time delay, an additional data block (4) may be output (rendered) from the buffers with no or a reduced time gap. The method continues with additional interrupt signals being issued at predetermined times programmed into the controller firmware until all data blocks in the input audio stream are decoded, processed, and output from the buffers.

Another embodiment corresponds to a computer-readable medium storing a program for performing any of the aforementioned methods described herein. The program may be stored as firmware or software in a memory or storage area in the host device or system. The memory may be a read-only memory, a flash memory, or another type of memory.

In accordance with one embodiment, the program includes a first code to decode a first set of data blocks, second code to decode a second set of data blocks, third code to process the first and second sets of decoded data blocks, and fourth code to control storage of the processed data blocks in a storage area. The computer-readable medium may further include fifth code to generate a first interrupt signal between decoding of the first and second sets of data blocks, and sixth code to generate a second interrupt signal during decoding of the second set of data blocks. The second interrupt signal may be applied at a time which reduces a time gap between storing adjacent ones of the data blocks of the first and second sets in the storage area.

In addition, the program may include seventh code to control outputting the first and second sets of processed data blocks at a first rate from the storage area to a circuit. The first and second sets of data blocks may be decoded at a second rate which is less than the first rate.

The second interrupt signal may be generated between decoding of a first data block in the second set of data blocks and a last data block in the second set of data blocks. Also, the first interrupt signal may cause a first delay time to occur between a last data block in the first set and a first data block in the second set, and the second interrupt signal may cause a second delay time to occur between one of the data blocks in the second set and another adjacent block in the second set.

While some of the foregoing embodiments have been described as an accelerator for audio data, other embodiments may be used to decode and process and store video data or other types of information different from or combined with audio data, with reduced or no time gaps during rendering the data from the buffers.

Additionally, any of the foregoing embodiments may be implemented separately from involving a central processing unit of the host device or system, in order to reduce processing overhead and power consumption and to account for more efficient operation during playback. Further, in accordance with any of the foregoing embodiments, the decoding process may involve a moving picture experts group (MPEG) standard such as but not limited to an MP3 standard.

In accordance with one embodiment, an apparatus comprises a decoder to decode first and second sets of data blocks; a processor to process the first and second sets of decoded data blocks; a storage area to store the first and second sets of processed data blocks; and a controller to control a rate at which data blocks are to be decoded by the decoder to reduce a time gap between outputting adjacent ones of the data blocks from the first and second sets in the storage area.

The controller may generate a first interrupt signal between decoding of the first and second sets of data blocks, and generate a second interrupt signal during decoding of the second set of data blocks, wherein the second interrupt signal is to be applied at a time to reduce the time gap between outputting adjacent ones of the data blocks from the first and second sets in the storage area.

The controller may generate the second interrupt signal between decoding of a first data block in the second set of data blocks and a last data block in the second set of data blocks. Also, the first interrupt signal may cause a first delay time to occur between a last data block in the first set and a first data block in the second set, and the second interrupt signal may cause a second delay time to occur between one of the data blocks in the second set and another adjacent data block in the second set. The first delay time and the second delay time may be different, and in one embodiment the second delay time is less than the first delay time.

The second interrupt signal may be applied at a time which substantially eliminates the time gap between outputting adjacent ones of the data blocks of the first and second sets in the storage area. Also, the storage area may output the first and second sets of processed data blocks at a first rate and the decoder is to decode the first and second sets of data blocks at a second rate which is less than the first rate. Also, the processor may process at least one data block in the first set during decoding of a data block in the second set.

Also, a number of data blocks in the first set may equal a number of data blocks in the second set. And, decoding of the data blocks in the first and second sets may control a rate of outputting processed ones of the data blocks of the first and second sets in the storage area. The first and second sets of data blocks may be audio data blocks.

Any reference in this specification to an "embodiment" means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. Also, the features of any one embodiment described herein may be combined with the features of one or more other embodiments to form additional embodiments.

Furthermore, for ease of understanding, certain functional blocks may have been delineated as separate blocks; however, these separately delineated blocks should not necessarily be construed as being in the order in which they are discussed or otherwise presented herein. For example, some blocks may be able to be performed in an alternative ordering, simultaneously, etc Although the present invention has been described herein with reference to a number of illustrative embodiments, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

We claim:

1. An apparatus comprising:

a decoder to decode first and second sets of data blocks;

a processor to process the first and second sets of decoded data blocks;

a storage area to store the first and second sets of processed data blocks; and a controller to control a rate at which data blocks are to be decoded by the decoder to reduce a time gap between outputting adjacent ones of the data blocks from the first and second sets in the storage area, wherein the controller is to generate a first interrupt signal between decoding of the first and second sets of data blocks, and to generate a second interrupt signal during decoding of the second set of data blocks, wherein the second interrupt signal is to be applied at a time to reduce the time gap between outputting adjacent ones of the data blocks from the first and second sets in the storage area.

2. The apparatus of claim 1, wherein the first and second sets of data blocks are audio data blocks.

3. The apparatus of claim 1, wherein the controller is to:

generate the second interrupt signal between decoding of a first data block in the second set of data blocks and a last data block in the second set of data blocks.

4. The apparatus of claim 1, wherein:

the first interrupt signal is to cause a first delay time to occur between a last data block in the first set and a first data block in the second set, and the second interrupt signal is to cause a second delay time to occur between one of the data blocks in the second set and another adjacent data block in the second set.

5. The apparatus of claim 4, wherein the first delay time and the second delay time are different.

6. The apparatus of claim 4, wherein the second delay time is less than the first delay time.

7. The apparatus of claim 1, wherein the second interrupt signal is to be applied at a time which substantially eliminates the time gap between outputting adjacent ones of the data blocks of the first and second sets in the storage area.

8. The apparatus of claim 1, wherein the storage area is to output the first and second sets of processed data blocks at a first rate and the decoder is to decode the first and second sets of data blocks at a second rate which is less than the first rate.

9. The apparatus of claim 1, wherein the processor is to process at least one data block in the first set during decoding of a data block in the second set.

10. The apparatus of claim 1, wherein a number of data blocks in the first set equals a number of data blocks in the second set.

11. The apparatus of claim 1, wherein decoding of the data blocks in the first and second sets controls a rate of outputting processed ones of the data blocks of the first and second sets in the storage area.

12. A non-transitory computer-readable medium storing a program for processing data, the computer-readable medium comprising:

first code to decode a first set of data blocks;

second code to decode a second set of data blocks;

third code to process the first and second sets of decoded data blocks; and fourth code to store the processed data blocks in a storage area, wherein the program further comprises code to control a rate at which data blocks are to be decoded to reduce a time gap between outputting adjacent ones of the data blocks from the first and second sets in the storage area, and the computer-readable medium comprising:

code to generate a first interrupt signal between decoding of the first and second sets of data blocks, and code to generate a second interrupt signal during decoding of the second set of data blocks, wherein the second interrupt signal is to be applied at a time which reduces the time gap between outputting adjacent ones of the data blocks of the first and second sets in the storage area.

13. The non-transitory medium of claim 12, wherein decoding of the data blocks in the first and second sets is to control a rate of outputting processed ones of the data blocks of the first and second sets in the storage area.

14. The non-transitory medium of claim 12, wherein the first and second sets of data blocks are audio data blocks.

15. The non-transitory medium of claim 12, wherein the second interrupt signal is to be generated between decoding of a first data block in the second set of data blocks and a last data block in the second set of data blocks.

16. The non-transitory medium of claim 12, wherein:

the first interrupt signal is to cause a first delay time to occur between a last data block in the first set and a first data block in the second set, and the second interrupt signal is to cause a second delay time to occur between one of the data blocks in the second set and another adjacent data block in the second set.

17. The non-transitory medium of claim 16, wherein the first delay time and the second delay time are different.

18. The non-transitory medium of claim 16, wherein the second delay time is less than the first delay time.

19. The non-transitory medium of claim 12, wherein the second interrupt signal is applied at a time which substantially eliminates the time gap between storing adjacent ones of the data blocks of the first and second sets in the storage area.

20. The non-transitory medium of claim 12, further comprising:

code to output the first and second sets of processed data blocks at a first rate from the storage area to a circuit, wherein the first and second sets of data blocks are to be decoded at a second rate which is less than the first rate.

21. The non-transitory medium of claim 12, wherein at least one data block in the first set is processed during decoding of a data block in the second set.

22. A method for processing data comprising:

decoding a first set of data blocks;

decoding a second set of data blocks;

processing the first and second sets of decoded data blocks; and controlling storage of the processed data blocks in a storage area, wherein the method further includes controlling a rate at which data blocks are decoded to reduce a time gap between outputting adjacent ones of the data blocks from the first and second sets in the storage area, wherein controlling the rate at which data blocks are decoded includes:

generating a first interrupt signal between decoding of the first and second sets of data blocks, and generating a second interrupt signal during decoding of the second set of data blocks, wherein the second interrupt signal is applied at a time which reduces the time gap between outputting adjacent ones of the data blocks of the first and second sets in the storage area.

23. The method of claim 22, wherein:

the first interrupt signal is to cause a first delay time to occur between a last data block in the first set and a first data block in the second set, and the second interrupt signal is to cause a second delay time to occur between one of the data blocks in the second set and another adjacent data block in the second set.

24. The method of claim 22, wherein the second interrupt signal is applied at a time which substantially eliminates the time gap between storing adjacent ones of the data blocks of the first and second sets in the storage area.

25. The method of claim 22, further comprising:

outputting the first and second sets of processed data blocks at a first rate from the storage area to a circuit, wherein the first and second sets of data blocks are decoded at a second rate which is less than the first rate.

26. The method of claim 22, wherein the second interrupt signal is generated between decoding of a first data block in the second set of data blocks and a last data block in the second set of data blocks.

* * * * *